United States Patent [19]

Kuehnle

[11] 4,006,986

[45] Feb. 8, 1977

[54] IMAGE RECORDING APPARATUS FOR ELECTROPHOTOGRAPHIC FILM

[75] Inventor: Manfred R. Kuehnle, Lexington, Mass.

[73] Assignee: Coulter Information Systems, Inc., Bedford, Mass.

[22] Filed: Jan. 20, 1975

[21] Appl. No.: 542,179

Related U.S. Application Data

[60] Division of Ser. No. 389,124, Aug. 17, 1973, and a continuation-in-part of Ser. No. 361,951, May 21, 1973, abandoned, which is a division of Ser. No. 260,782, June 8, 1972.

[52] U.S. Cl. ..... 355/14; 355/16; 355/71

[51] Int. Cl.[2] ..... G03G 15/00

[58] Field of Search ..... 355/3 R, 14, 16, 64, 355/71

[56] References Cited

UNITED STATES PATENTS

| | | | |
|---|---|---|---|
| 3,062,095 | 11/1962 | Rutkus et al. | 355/14 X |
| 3,602,589 | 8/1971 | Dietz | 355/14 |
| 3,645,619 | 2/1972 | Burton et al. | 355/64 X |
| 3,746,443 | 7/1973 | Hickey | 355/14 |
| 3,790,273 | 2/1974 | Tanaka | 355/16 |
| 3,791,732 | 2/1974 | Mihalik et al. | 355/14 |
| 3,819,261 | 6/1974 | Ogawa | 355/14 |

*Primary Examiner*—R. L. Moses
*Attorney, Agent, or Firm*—Silverman & Cass, Ltd.

[57] ABSTRACT

A system for impressing images on electrophotographic film provides apparatus for charging each film frame rapidly to a peak voltage determined by the prevailing light conditions of the image to be produced or recorded. After charging, means are provided for immediately exposing the frame to an image. In the preferred apparatus, means are provided for adjusting the time of exposure to a fixed period which is predetermined. Means are provided for applying toner to the exposed frame immediately after exposure in the presence of a bias field which propels the toner particles toward the film. Thereafter excess toner is removed from the film or leaves the frame and the remaining toner is fused to the surface of the film to form a permanent visible image on the film frame. An alternate form of the invention provides means for transferring the toned image to an acceptor member where it is fixed.

The apparatus includes structure which enables the processes above described to be carried out along a line or in a rotary arrangement. Electronic and electrical circuitry are provided for accomplishing the various functions in proper sequence and timing.

The apparatus is arranged to carry out the processes at points on the dark decay portion of the characteristic discharge curve for the particular film so that the resultant image has high resolution, optimum contrast and a substantially continuous gray scale. The quality is as good as if not better than photographic quality. The sensitivity of the film is controlled by the level to which it is charged and circuitry provided enables this to be automatically accomplished. The level in turn is chosen on the basis of the average light of the image or scene to be recorded and means are provided to accomplish this automatically or manually.

8 Claims, 5 Drawing Figures

IMAGE RECORDING APPARATUS FOR ELECTROPHOTOGRAPHIC FILM

CROSS-REFERENCE TO RELATED APPLICATIONS

This is a Division of application Ser. No. 389,124 filed Aug. 17, 1973, and a continuation-in-part of an application entitled "Image Recording Apparatus for Electrophotographic Film" Ser. No. 361,951 filed May, 21, 1973, now abandoned.

The above entitled application Ser. No. 361,951 is a divisional patent application filed in response to a requirement for restriction which was made by the Patent Office in a parent application originally entitled "Image Recording Apparatus for Electro-Photographic Film" Ser. No. 260,782 filed June 8, 1972.

The title of the parent case Ser. No. 260,782 was changed to "Image Recording Method for Electrophotographic Film" and only method claims were retained in that application. A copending application has been filed as a continuation-in-part of the parent case Ser. No. 260,782 having the same title and again having only method claims. This latter copending continuation-in-part application is identified as Ser. No. 389,149 filed Aug. 17, 1973, now abandoned, and 688,623 filed May 21, 1976.

The instant patent application contains only apparatus claims.

Reference will be made in this application to electrophotographic film of a certain construction and manufactured in a certain manner. Such film and the manner of manufacture and use of the same is fully disclosed in a copending application entitled "Electrophotographic Film and Method of Making and Using the Same and Photoconductive Coating Used Therewith" Ser. No. 378,180, filed July 11, 1973. This latter application is a continuation-in-part of two succeeding applications identified therein.

All of the above applications together with the parent one are owned by the same Assignee.

BACKGROUND OF THE INVENTION

This invention is concerned with apparatus for recording high quality images on electrophotographic film.

There presently exist a large variety of electrostatic image recorders which rely for their operation on certain well-known basic steps. First an electrical charge is applied to a previously discharged photoconductive medium after which the medium is exposed to a light pattern to form a latent image thereon in the form of incremental areas which remain charged and other incremental areas which are discharged. The initial charge places a great number of electrons at or slightly below the surface of the medium. The light pattern furnishes photons which cause the electrons to migrate toward an ohmic member which normally comprises a layer of some conductor below the photoconductive medium. Increments of the medium which are subjected to high intensities of light will discharge their electrons more rapidly and fuller than those increments which are subject to lesser light intensities. The totally unilluminated increments theoretically will not discharge their electrons at all, although, as will be seen, there is a continuous discharge which occurs even in total darkness, the degree of which is dependent upon the nature of the photoconductive medium.

Continuing with the basic steps which are known, and carried out by known apparatus, after exposure, there exists on the photoconductive medium a latent image which is a duplication of the pattern to which the medium has been exposed. The dark increments have the greater retained charge and the light increments have the lesser retained charge. Toner is then applied to this latent image to make it visible, the toner comprising fine particles of carbon, resin and the like which are electrophoretic in nature and hence attracted to the charged increments and not to the uncharged increments. The range of grey tones capable of being achieved depends upon the ability of the medium to retain a gradient of charge between the extremes of dead black and dead white (full charge and total absence, respectively). So far as is known, available photoconductive mediums are incapable of achieving the grey scale which can be achieved by the electrophotographic film which will be described herein and which is disclosed in said copending application, Ser. No. 378,180.

Once the toner has been applied to the latent image the image becomes visible and is either capable of being transferred to another member (xerography) or fused in place on the photoconductive medium (electrofacsimile, called electrofax). In the first instance, image copiers utilize a member which comprises a metal drum having a surface of amorphous selenium, the toned image being transferred to a sheet of paper and fused thereon. In the second instance, image copiers utilize electrophotographic members which comprise sheets of conductive paper having coatings of zinc oxide-resin mixtures. The latent image is formed directly upon the photoconductive surface of the paper, passed through a toner bath and thereafter fused in place.

The same techniques and apparatus for practicing the same have been proposed for the production of images of photographic quality, such as for example, the production of microimages. The problems with these known techniques that prevent this include the inability to produce high resolution images. For example, where an image is to be magnified on the order of twenty times for reproduction or viewing or printing, imperfections likewise are magnified. To obtain a resolution in the enlarged image of five lines per millimeter the basic image must have a resolution of one hundred lines per millimeter. Systems proposed heretofore have not been capable of achieving such resolution, so far as is known. In the system proposed herein, resolutions of the order of one thousand lines per millimeter are practically achievable.

Another aspect of the problems lies in the quality of the images which can be achieved by known xerographic and electrofax apparatus and techniques. In high quality photography the film speed enables the capture of moving scenes and a great range of tones enables the reproduction of images with natural appearance. The known xerography and electrofax techniques mentioned are slow, have limited tone gradients and produce extremely contrasty images. They cannot be favorably compared even with low quality photographic film. Their use in microimaging is thus obviated because they cannot produce the basic requirements of microimages.

According to the invention, all of these difficulties are overcome by the use of the electrophotographic film which is disclosed in the said copending application, Ser. No. 378,180 and by the techniques which will be detailed hereinafter.

Heretofore, the various steps in electrophotography have been treated as a succession of static, unrelated events. First, the photosensitive medium is charged, then it is exposed to an image. Light falls on the portions of the medium corresponding to the light areas of the image, causing the charge on those areas to dissipate while those portions of the medium corresponding to the dark areas of the image retain their charge. In this way, a latent photographic image is formed on the medium. Following this, toner is applied to the medium which tends to adhere to those portions thereof which still retain an electric charge, thereby reducing the latent image to visible form. Finally, the toner is fused to the medium so that the image thereon becomes permanent or the image is transferred to another member where it is fused.

The aforesaid steps are performed in successive time intervals, usually at different locations in the reproduction apparatus. There is no relation between the times of the various steps.

More significantly, since the prior processes are concerned with impressing a relatively low resolution image on a relatively large image area, they operate at relatively slow copying speeds, i.e. 2 to 10 seconds.

A typical photoconductive medium such as selenium has a characteristic dark decay curve. Once charged to its customary initial voltage, e.g. 500–600 volts, it exhibits a fairly rapid rate of decay, e.g. 50–100 volts/-min. during the first minute or so. Then the rate of decay gradually becomes less until the surface potential reaches a substantially constant residual background value of about 30–50 volts. Conventional xerography systems, being fairly slow as noted above, process the medium at a time when the rate of decay of the charge on the medium is fairly slow.

The development of high quality images, especially on microfilm, requires an entirely different approach. The area to be imaged may be very small although as seen the invention herein is not so limited. Also, the resolution and tonal range requirements of imaging intended to compete with high speed, high resolution photography are much higher than is the case with larger xerographic or electrofax prints.

Thus, in contrast to the foregoing, the present technique involves controlling the steps of a reproducing process as a dynamic series of interrelated events, some of which are performed concurrently and all of which are performed on a greatly collapsed time scale as compared with conventional xerographic or electrofax processes. The voltages which are involved are substantially less than those used in prior processes although due to the techniques used, the field strength per unit thickness is extremely higher than that of prior art members. In the film used it is of the order of $10^6$ volts per centimeter although the maximum surface potential to which the electrophotographic film will be charged is of the order of 50 volts. Note that in prior art photoconductive members the order of surface potential is 500 to 600 volts and the noise voltage is of the order of 50 volts.

The important steps according to the invention are all carried out with the described apparatus at a period of time when the charge on the medium is decaying most rapidly, that is, very early on the characteristic dark decay curve of the electrophotographic medium. For best results it is essential that the photoconductive film being processed have high speed, that is a high electronic gain and a high ratio between dark and light resistivity. Applicant has developed a film for this purpose which is fully disclosed in the said copending application Ser. No. 378,180. A short description of this electrophotographic film will suffice to provide an understanding of its relationship to the method of the invention.

The electrophotographic film of the said copending application, Ser. No. 378,180, is based upon a polyester substrate of the type sold by E. I. DuPont de Nemours Company as "Mylar" having a thickness of about 0.005 inches and being transparent and quite flexible. After normal outgassing and radioactive brushing, an ohmic coating such as indium oxide is sputtered by R. F. plasma sputtering techniques on the substrate to a thickness of about 500 Angstroms. Then a coating of photoconductive material is sputtered onto the ohmic coating by means of R.F. plasma sputtering, but using a special bias circuit in the power supply. The material which has been successfully coated is cadmium sulfide at a thickness of the order of 3000 Angstroms.

The coating which results is flexible, transparent, n-type, hard as glass and abrasion resistant, has extremely high gain and hence high speed, is oriented crystalline and has a dark resistivity of about $10^{12}$ ohm centimeters. Its light resistivity is about $10^8$ ohm centimeters, thus giving a ratio of about $10^4$.

Other materials named in the said copending application, Ser. No. 378,180, may be used to produce an electrophotographic film for use in the method of this invention, but the most satisfactory thus far has been the one utilizing cadmium sulfide.

No other electrophotographic film is known at this time which is the equivalent of the above-mentioned, but others may exist which have sufficient of the characteristics to utilize the method and apparatus of the invention.

One of the most important aspects of the invention is the utilization of the variable sensitivity of the electrophotographic film to achieve excellent results and quality in the eventually reproduced images almost without regard to the light conditions. Specifically, the method and apparatus of the invention contemplates that the voltage to which the electrophotographic film is charged will be determined by the incident light, that is, the average lighting conditions of the image to be reproduced. So far as known, this has not been utilized in any prior art apparatus or method. Most, if not all, reproducing machines for copying (so far as known, no xerographic or electrofax apparatus is used commercially for photography) utilize brilliant lights of a fixed intensity to illuminate the material being copied. The prior art photoconductive media are insufficiently sensitive to suggest that the sensitivity of the photoconductive medium may be varied in accordance with the ambient light.

SUMMARY OF THE INVENTION

In accordance with the present technique, the electrophotographic film, or more particularly its photoconductive layer is charged by corona or other means, the light conditions being monitored by means of a suitable light responsive device such as a light meter. The surface charge is also measured at the same time and a surface charge is chosen which represents the best film sensitivity for the particular light conditions which were measured. Since the speed of charge is substantially greater than that of conventional photoconductive media, the technique preferably contemplates that the adjustment will be done automatically and apparatus to accomplish this is provided.

Since the speed of charging is faster than that of conventional photoconductive media, for minimum light conditions, for example, the photoconductive coating will normally be charged substantially above saturation, this being referred to as shocking the coating. The prevailing practice in the prior art is to charge the xerographic or electrofax member to saturation level, this being the condition at which the chage buildup on the electrophotographic medium is equal to the charge leading off the medium. Conditions of electrical breakdown are the only physical limitations to the charging level of the photoconductive coating according to the invention. The time for charging of a typical prior art photoconductive member may be of the order of one to several seconds. According to the invention, the charging time for the method thereof will be of the order of 200 to 300 milliseconds. In this period of time the surface potential of the coating may rise to 40 or 50 volts which, due to the extremely thin coating, gives the extremely high field strength mentioned above.

As soon as the charge level on the surface of the electrophotographic film reaches the desired peak which is controlled by the measurement of light by the light meter, the film is exposed for a fixed time. The exposure is effected immediately after the maximum charge is reached at a time when the dark decay characteristic is dropping rapidly toward the saturation level (under conditions of minimum light) and will probably be completed before the saturation level is reached.

Following this, the toning process is initiated for a period of time which is to at least some extent related to the time of exposure. For the most part the toning time can be fairly fixed. The toner is applied to the surface of the film uniformly and rapidly. A bias voltage is utilized in close proximity to the film coating to accelerate the particles toward the film and to provide even particle distribution which will minimize lateral particle migration. This latter phenomena cause the well-known edge effect in prior art apparatus on relatively dark images.

Finally, if required, which is usually not the case, any excess toner may be swept away from the film surface and the remaining toner fused to the surface so that the entire process is completed before the surface voltage has dissipated substantially.

It is of consequence to mention that in the invention, the image resulting may be enhanced by varying the length of the toning or the amount of the bias without bringing up the background. In other words, prior methods and photoconductive media had a continuous background level of at least 40 or 50 volts. According to the invention, since there is no background level to speak of, the background will be affected in no discernible manner even if efforts are made to intensify the image by toning for longer than a normal time.

When processed in the manner described, the image on the film is characterized by a high degree of resolution, an almost continuous grey scale extending from intense black to pure white for black and white images and an exceptionally clean background. When the image is projected on a greatly enlarged scale for viewing or copying purposes the quality is as good, if not better than photographic. In any event, the subject matter which is capable of being recorded by the invention is not limited to copying documents as in the case of prior xerographic and electrofax techniques. As a matter of fact, the method of the invention is feasible for use with camera equipment not dissimilar in intended purpose from conventional cameras.

The invention herein provides apparatus for carrying out the above described process.

BEIEF DESCRIPTION OF THE DRAWINGS

FIG. 1 is a block diagram of a system from recording images on electrophotographic film, said system embodying the principles of the invention;

FIGS. 2 and 2*a* are graphs illustrating in greater detail the operation of the system illustrated in block diagram form in FIG. 1 for two different conditions of ambient light;

DESCRIPTION OF THE PREFERRED EMBODIMENT

Figure 1:
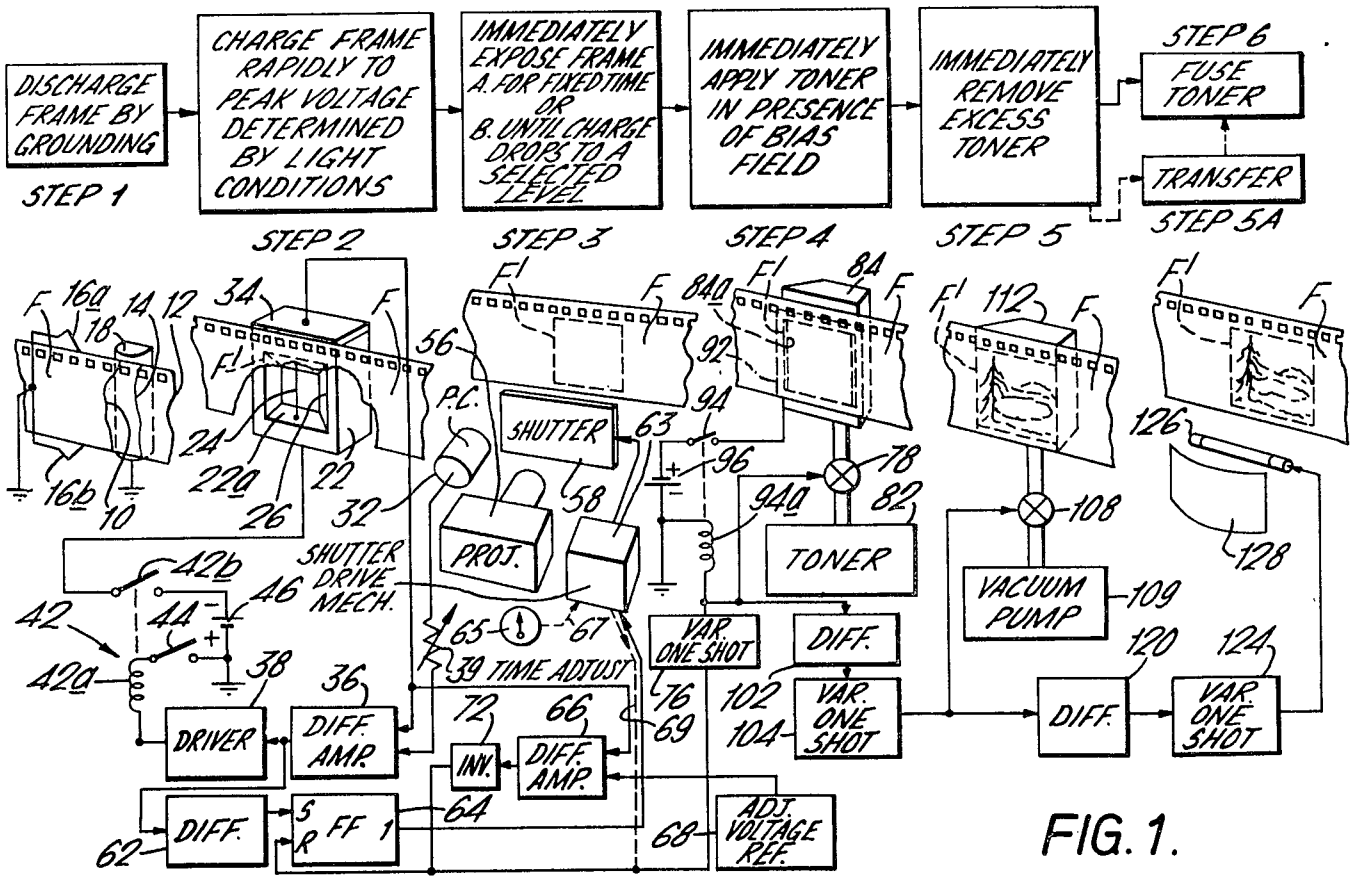

Referring to FIG. 1 of the drawings, the system of the invention is shown as utilized with strip film such as illustrated at F. This could be microfilm, 35 millimeter film or any form of strip film upon which it is desired to record images. According to the systems which are illustrated, in FIGS. 1 and 3, the process and apparatus appear to be especially adapted for commercial use or copying. As will be understood from the discussion and a more detailed description which will follow, the invention is applicable for embodiment in single frame cameras, or reproducing apparatus which does not necessarily utilize strip material.

In the description herein, the apparatus of the invention will be set forth in detail as exemplary. This and other types of apparatus are capable of being used to practice the methods of the invention claimed in the said copending application Serial No.

The film F which is illustrated in the drawings is of the construction that has been mentioned above, that is, it is electrophotographic in nature. It includes a transparent plastic substrate 10 which is relatively tough, thin and flexible, a photoconductive layer or coating 12 which is preferably cadmium sulfide deposited by R.F. sputtering techniques as explained in said copending application, Ser. No. 378,180, and an intermediate conductive or ground layer 14. A pair of resilient grounded contacts 16*a* and 16*b* slidably engage the opposite edges of the conductive layer 14 in a wiping contact to maintain that layer at ground potential. Other methods of assuring that the conductive layer is at ground potential, at least when it is desired to discharge the photoconductive surface are described in said copending application, Ser. No. 378,180. In said latter copending application, the conductive layer 14 is called an ohmic layer and its deposit on the substrate 10 is also effected preferably by R.F. sputtering techniques.

As shown by the first block and the first part of the diagram, STEP 1 is stated to be "Discharge Frame by Grounding." The frame of the film F is designated F′ and this rectangular area will be carried across the various stations of the apparatus in a strip film processing technique. There is provided a grounded discharge head 18 which is intended to remove any electrical charge which may be present on the photoconductive layer 12. In the case of apparatus for processing individual electrophotographic members this step is usually not necessary and even in processing strips it is unlikely that any charge will be carried out on the film F. In the case of film members which are to be used over and over again, as in the event that the toned image is to be transferred there is a possibility of such residual charge remaining, but in the use of film which is used only once and hence is installed in the apparatus new, the handling and exposure to light before use will certainly discharge any static charges which may have accumulated by whatever cause.

Thus, the first most important step of the process or method of the invention is that which is represented by the block marked STEP 2 and designated "Charge Frame Rapidly to Peak Voltage Determined by Light Conditions." In accordance with this step, the frame F′ is advanced past a charge head 22. This head has a recess 22*a* in its side wall over which the frame F′ is disposed and which is coextensive with the area of the film frame F′. A corona discharge wire 24 extends across the recess 22*a* opposite the film F. When a relatively high potential is applied to the wire 24 which is negative with respect to ground, a corona is generated in the vicinity of the wire 24 and this corona causes the photoconductive coating 12 defined by the frame F′ to become negatively charged. Electrons tend to be produced at or below the surface of the coating, holes tending to move toward the contiguous ohmic layer 14.

The voltage to which the wire 24 is subjected is of the order of kilovolts, typically 5000 to 6000 volts. In the case of the prior photoconductive surfaces, the order of surface potential of the said surfaces is 500 to 600 volts. In the case of the electrophotographic film of the copending application, Ser. No. 378,180, the surface potential is normally less than 50 volts.

The characteristics of the electrophotographic film F and the charging of the surface thereof will best be explained in connection with FIG. 2 which is a graph of the surface voltage of the photoconductive coating 12 charted against time. FIG. 2*a* is a somewhat similar graph but showing the surface voltage for a different condition of light.

Figure 2:
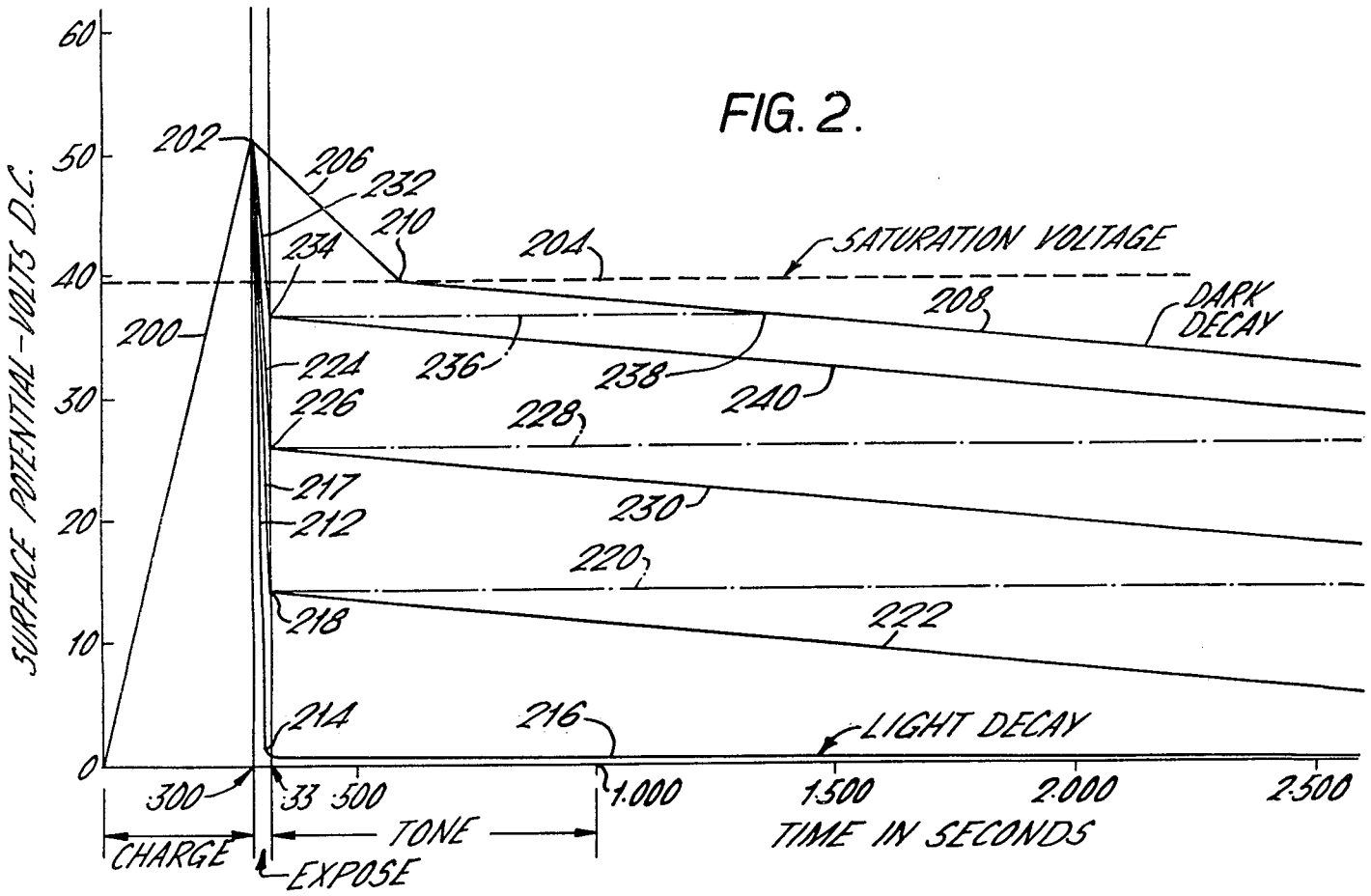
Figure 2A:
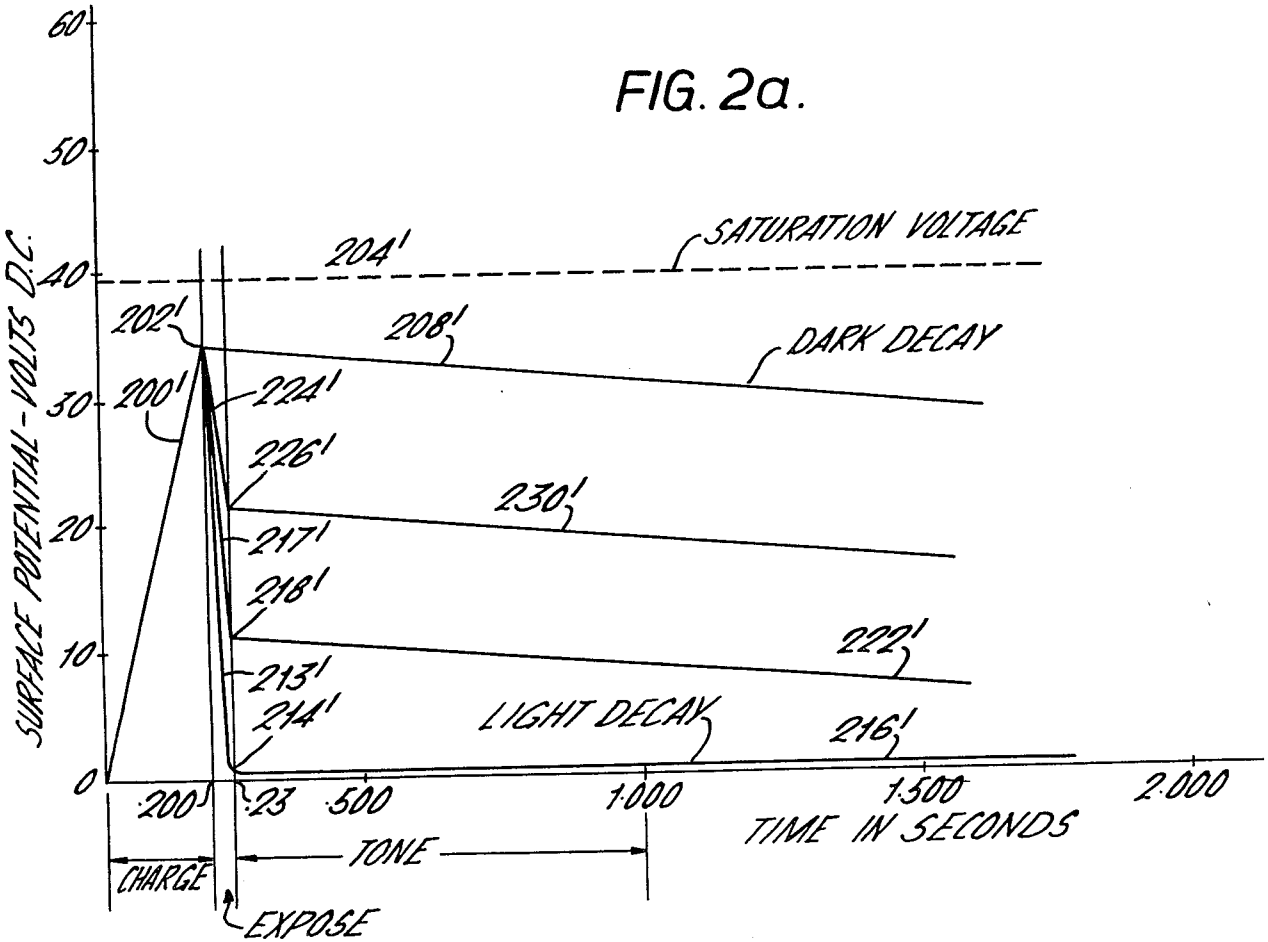

In the case of FIG. 2 it is assumed that the lighting intensity is minimum and hence the charging of the photoconductive surface is to proceed to a maximum value. The thinness of the coating 14, its photoelectric gain and the substantial ratio between dark and light decay characteristics result in the great difference in time and voltage quantities mentioned above over the prior art. In FIG. 2, for example, the entire process can be completed never exceeding about 52 volts surface potential and within a space of substantially less than 2 seconds. In the prior art the surface potentials are of the order of 500 to 600 volts and the time required for completing a process extends to many units of seconds. As a matter of fact, the charging of a selenium photoconductive coating to a surface voltage enabling it to accept charge and produce a visible image upon exposure is of the order of 2 seconds.

Thus, the invention contemplates that the photoconductive coating 12 is shocked very rapidly to a voltage which is above the saturation voltage. The charge line 200 is shown to be very steep, rising to about 52 volts in about 300 milliseconds. The peak to which the coating 12 is charged by the wire 24 is here shown at 202. The saturation voltage for the preferred cadmium sulfide photoconductive coating is slightly less than 40 volts and this is illustrated by the broken line 204 in FIG. 2. For other compounds this voltage and the others represented in the graph will vary somewhat.

As explained, the voltage to which the surface of the coating 12 is charged is controlled by the ambient or average light of the image or scene to be recorded. This will be explained in connection with the circuitry illustrated but for the moment an explanation of the discharge characteristics of the photoconductive coating is useful.

If from the point 202 the film F remains in darkness (and it is intended that the charging will take place in darkness) then the electrons which are sitting at or near the surface will tend to migrate toward the ohmic layer 14 to combine with holes which tend to move in the opposite direction. The discharge, as it is known, will lower the voltage of the surface along the characteristic line 206 at a fairly fast rate to the saturation level 210. This is due to the fact that the film surface is in effect "overcharged" and wants to dump charge as fast as it can. Once the saturation level 204 has been reached, the rate of discharge decreases and the curve is flatter as indicated at 208. The curve 206, changing slope at 210 and continuing along the line 208 is known as the dark decay curve. This curve is totally different from the dark decay curves of prior photoconductive members which fall away at a much greater rate.

Now, on the other hand, if the film is subjected to total brilliant light at the time 0.300 second commencing at the voltage 202, the discharge will be practically complete and almost instantaneous. It will drop along the steep line 212 in a few milliseconds to a voltage at the knee 214 which is so close to zero as to be almost immeasurable. The characteristic discharge thereafter will approach zero asymptotically along the line 216. This curve comprises what is known as the light decay curve and again it differs radically from that which is known in the prior art. Prior art light decay curves are not as steep and cannot reach a condition of discharge which is close to zero. As a matter of fact, there is a background charge which persists in prior art photoconductive surfaces which is of the order to 40 volts or more and as can be seen, most of the phenomena occurring according to the invention take place below 40 volts. Noise is another limitation on prior art photoconductive surfaces such noise being of the same order as the background.

When it is considered that the charge on the surface will cause the adherence of toner particles it can be appreciated that the very flat dark decay characteristic 206–208 means that it is feasible to achieve intense black areas without over-toning. The light decay characteristic dropping to zero means that it is feasible to achieve practically dead white areas with no speckles or grey background.

The curves 232–234–240, 224–226–230, 217–218–222 represent intermediate discharge curves as where the intensity of light is between total darkness and total brilliant light. The steepness of the curves 232, 224 and 217 indicates that the photoconductive surface has enormous gain when subjected to light and hence can discharge rapidly. In every case the discharge occurs in a few milliseconds time. The sharpness of the knees 234, 226 and 218 indicates that when the light is cut off the discharge stops instantaneously.

The flat curves 240, 230 and 222 are nothing more than portions of the dark decay curve 208 shifted from far off the right-hand end of the graph to the left along the lines 236, 228 and 220 respectively. The one that is visible is the shifting of the portion of the curve 208 on the right of the point 238 to the left to be attached to the bottom end of the curve 234. It will be appreciated that in this discussion it is assumed that the exposure has taken place in the period of 30 milliseconds after charging so that all of the knees 234, 226 and 218 occur at the time 0.330 second. The knee 214 being at the bottom of total discharge would occur irrespective of the time of exposure.

The electrical anisotropy of the photoconductive coating makes it possible for each increment to behave differently in accordance with the intensity of light, that is, the number of photons which impinge against it. Thus, each increment will have a characteristic discharge curve like one of those described above (for example, 232–234–240) and there will be as many such curves as increments. The resolution of the electrophotographic film depends upon the independent response of the smallest increments which, so far as known in connection with the film of the said copending application, Ser. No. 378,180, is limited only by the size of the crystalline systems produced during the deposit of the coating. It has been determined that the discrimination is so great between such systems that there is no discernible gain in images produced using such film. An important point to be realized from an examination of FIG. 2 is that the number of discharge curves representing the actual phenomena is practically infinite for even the smallest area of film.

According to the invention, the voltage to which the photoconductive surface 12 is charged depends upon the amount of ambient light or the average light of the scene or image to be recorded. The reason is that the sensitivity of the film is dependent upon this voltage. The higher the surface voltage the greater the sensitivity. It thus becomes feasible to adjust the sensitivity through the use of this phenomenon for different conditions of light. For low intensity light conditions the sensitivity is increased and for high intensity light conditions the sensitivity is decreased. FIG. 2 shows the conditions when the light intensity is low and FIG. 2*a* shows the conditions when the light intensity is high. In each case, as will be explained, the time of exposure is fixed. It can be appreciated that in any apparatus, the elimination of adjustments for time of exposure is a very desirable feature.

In FIG. 2*a* like reference characters designate similar curves and points illustrated in FIG. 2 but differing by being primed. Thus, the charging curve 200′ rises rapidly to the point 202′ which, in this case, is considerably below the saturation level 204′. This latter is identical to the level 204 of FIG. 2. It has been assumed that the amount of light available for the image to be recorded is quite substantially greater than it is in the case of FIG. 2 and hence there is no need to charge the photoconductive coating 12 to a voltage of 52. Instead it is charged only to a voltage of about 36. At this point, the characteristic dark decay curve 208′ commences to fall away slowly, without any rapid initial discharge equivalent to that represented by the curve 206 of FIG. 2. The light decay curve commences along the steep discharge 212′ and proceeds to the knee 214′ slightly above zero and then follows the asymptotic line 216′ toward total discharge.

It is to be noted that the charging of the photoconductive coating in FIG. 2*a* took only 200 milliseconds instead of the 300 required under the conditions of FIG. 2. This time is controlled by the surface potential 202′ which in turn has been chosen as the optimum for the light conditions measured by the apparatus.

The exposure time in this case is again 30 milliseconds, this preferably being fixed in the apparatus. In the period of exposure, the different increments of the photoconductive coating are again subjected to different intensities of light. Each increment will discharge in accordance with the amount of such light, giving a large number of discharge characteristics typical ones of which are shown at 224′ and 217′. These are similar to the discharge curves 232, 224, and 217 of FIG. 2. The slopes of these curves of FIG. 2*a* are not quite as steep as those of FIG. 2, although the knees 226′, 218′ and 214′ are as abrupt as the knees of FIG. 2. The reason for the decreased slopes is the fact that the conductive coating is not as sensitive in FIG. 2*a* as it is in FIG. 2. The dark discharge curves are substantially the same, these being 230′ and 222′ to the right of the time 0.23 second.

In order to measure the ambient light for ascertaining the surface voltage to which the photoconductive coating 12 is to be charged, there is a photocell 32 placed adjacent the film frame F′ being exposed so that its output is proportional to the amount of light which is incident on the film. The photocell will be directed toward the source of the scene or may even be arranged by suitable optical means to pick up the light which passes through a chosen corner of the film, etc.

It is noted that the photocell 32 of a light meter (or any other measuring apparatus) is shown independent of the projector 56. While it is necessary that the photoresponsive device 32 see the ambient light of the scene before exposure in order to control film sensitivity, it need not be independent of the projector 56. It can be in the projector path so that the light of the projected scene is measured, so long as it can respond before exposure. It can respond to average incident light, the relation to charge voltage for this condition being worked out by means of a series of tests.

An example of the apparatus has the output of the photocell 32 inverted so that the signal varies inversely as the intensity of light. This is a convenience since the end result will be a lower charging voltage for a brighter light. The charge on the film F is monitored by an electrometer 34 which is incorporated into the head 22. The electrometer is arranged to develop a voltage which is proportional to the surface charge on a nonilluminated portion of the frame, for example, a dark corner beyond the image area. Accordingly, its output will follow the charging curve 200 or 200′.

The output signals of the photocell 32 and the electrometer 34 are applied to a differential amplifier 36 adjusted to have high gain so that when its two input signals become equal, the output voltage of the amplifier 36 drops rapidly. A variable resistor 39 which varies the input from the photocell 32 provides an adjustable reference setting.

The output of the amplifier 36 is applied to a current driver 38 which is, in turn, connected to the coil 42*a* of a relay 42, the other end of which is connected by a switch 44 to ground. Coil 42*a* controls a switch 42*b* which connects the corona wire 24 in head 22 to a negative voltage supply indicated by the battery 46. Switch 44 is normally open, as is the relay switch 42*b*.

Switch 44 is closed when the film frame F′ is properly positioned in front of head 22 as indicated in FIG. 1. The switch closure may be effected manually or automatically by way of the mechanism which incrementally moves the film. In any event, it is closed for the duration of the charging operation.

The closing of switch 44 energizes the relay coil 42 which, in turn, closes the relay switch 42*b*. This energizes the corona wire 24 and commences the charging operation. As the surface charge on the film F builds up, the voltage represented thereby at a nonilluminated portion of the film is sensed by the electrometer 34 which develops an output signal proportional to that charge. As soon as that output equals the voltage applied to amplifier 36 by the photocell 32, the output of the driver 38 drops and the relay 42 is deenergized. This opens switch 42*b*, thereby completing the charging operation.

If the photocell 32 senses that the light incident on the film frame F′ is quite intense, then a relatively low voltage is applied to the amplifier 36. This means that a relatively small charge on the film frame F′ will cause an equal output from the electrometer 34 and thereby terminate the charging operation relatively quickly. In this case, the film will be charged to a relatively low peak voltage as indicated by point 202′ on the curve 200 of FIG. 2*a*. On the other hand, if the photocell 32 senses that the incident light is not as bright, then a higher voltage is applied from the photocell to the differential amplifier 36; consequently, it will require a greater charge on the film to develop the output from the electrometer 34 that will terminate the charging operation. In this event, the film is charged to a higher peak voltage as typified by the point 202 on curve 200 in FIG. 2.

Desirably, the film is charged to the correct peak voltage as quickly as possible. This is accomplished by subjecting the film to a relatively high voltage which may be in excess of the saturation voltage for the film and may even approach the breakdown voltage of the film but will always be below this voltage. This is possible with the present system because immediately after the film is charged, it is exposed to the image being reproduced, as will be described presently. Thus, the charge on the film is reduced before actual breakdown can occur.

As will be deduced from the graphs of FIGS. 2 and 2*a*, it is intended that there will be no time elapsing between the moment that the proper surface potential has been reached and the instant that the exposure commences. This is clear from the fact that in each case the "Expose" period begins immediately after the "Charge" period. In FIG. 2, the exposure of the photoconductive surface 12 to the scene or image to be recorded commences at 0.300 second and in the case of FIG. 2*a* exposure commences at 0.200 second. The apparatus used to practice the invention is advantageously constructed to minimize the lapse of time between the end of charging and the commencement of exposure. There are many mechanical techniques which can be used and which enable movement of physical members at extremely high speed. Note for example, the mechanisms which are used in high speed single reflex cameras to move a mirror. For purposes of explanation it may be said that the film F is moved to a succeeding station from the charging head 22, but movement of the film member is not totally essential. The presence of a fine wire such as 24 in an optical train at a location where it is out of focus will have no effect upon the image seen by the film. Thus it is feasible to leave the wire 24 in place at all times and make the exposure without moving either the film F or the wire support 22. Various arrangements will suggest themselves to those skilled in this art.

While it is feasible to work out the apparatus for practicing the method of the invention in such a manner that the exposure is timed in accordance with the charge on the film reaching a certain level, this is not preferred. It is preferred to establish a time of exposure which is satisfactory for most of the recording to be executed and use that time for all exposures. Thus, in FIGS. 2 and 2*a*, although the sensitivity of the film is different in each case, having been adjusted in accordance with light conditions, the time of exposure is 30 milliseconds. The light and dark decay curves are shown in these views for both conditions. Likewise examples of discharge curves for increments illuminated somewhere between maximum and minimum light are shown in order to illustrate the range of voltages and hence the range of grey tones which will be achieved.

Where there is a low ratio between dark and light resistivity as in the case of prior art photoconductive members, the time of exposure is important to the eventual results achieved primarily because of the problems of toning to obtain a good grey scale and even simple contrast. Thus, assuming that the dark decay curve falls off rapidly immediately after charging has been completed, it may follow closely the light decay curve so that for a short exposure time it is very difficult to obtain substantial charge differential on the illuminated and nonilluminated portions of the frame. In that case, it is advisable to adjust the exposure time to give the dark decay curve an opportunity to flatten out and establish a greater differential between the charge on illuminated and nonilluminated areas. The charge level of an unilluminated portion for a given type of film can be ascertained and this information used in suitable apparatus to control the time of exposure, as will be explained. This problem, however, is more acute in the case of prior art photoconductive media and the solution described herein is for the most part not necessary in the case of the electrophotographic film which is disclosed in copending application, Ser. No. 378,180. This can be ascertained from an examination of the graphs of FIGS. 2 and 2*a*.

In those two graphs, it can be understood that the illumination of the photoconductive surface 12 by light results in an immediate and precipitous discharge so that within a period of a millisecond or two there is a vast difference in charge between the increments which are illuminated and those which are not. Accordingly, there is no need to extend the exposure to a point where the difference between the dark and light decay curves increases. As a matter of fact, the discharge curves for increments of intermediate illumination drop at such a rapid rate that too long an exposure can result in such discharge of the surface that the image will deteriorate. The high rate of discharge of the photoconductive surface is due to its extremely high electrical gain. A film having a photoconductive surface with moderate gain might benefit from the extension of the exposure time to give better contrast. This affords a good control of density, grey scale, etc. on such film.

In FIG. 1 there is indicated a conventional projector 56 which projects the image to be reproduced onto the frame F'. As previously mentioned, the apparatus could be constructed in the form of a small camera having a primary lens system for direct viewing of a scene instead of being used in copying. A normally closed shutter system 58 is positioned between the projector and the film F to control the duration of the exposure. The shutter is actuated to open as soon as the charging operation is completed by the drop of the output voltage of the differential amplifier 36. A differentiator 62 detects the negative going pulse from the amplifier output and applies a signal to the SET input of a flip-flop 64. The output of the flip-flop at the I terminal energizes the shutter drive mechanism 63 which can be any type of conventional shutter drive suitably modified or adjusted.

The two methods of controlling exposure which have been mentioned require apparatus which is readily incorporated into the system. Where the shutter 58 is to be operated for a preset period of time, the shutter mechanism itself may have an automatic timing device which returns the shutter to its closed condition after the period has expired. A simple timing control 65 which is manually adjustable is shown connected by the broken line 67 to the shutter drive mechanism 63 to signify that it is an alternate to the circuitry shown in solid lines. In such case, where the flip-flop 64 is used, it is a simple matter to provide for a reset signal to be generated by the shutter drive mechanism simultaneously with the end of the exposure period, this signal being transmitted by the line 69 to the rest terminal R.

The second method of control and one which is needed only in the event that a lower gain film is used is somewhat more complex. The charge on the frame F' at an unilluminated portion is monitored during exposure by the electrometer 34. The output signal of the electrometer 34, in addition to being applied to the differential amplifier 36 is also applied to the high gain differential amplifier 66. This amplifier 66 also receives the output voltage from an adjustable reference voltage source 68. The output signal of the amplifier 66 is applied by way of the inverter 72 to the RESET input of the flip-flop 64. The adjustable reference voltage source 68 is arranged to terminate the exposure of the film when the charge on the nonilluminated portion monitored by the electrometer reaches a selected value. When this point is reached, the output voltage of the amplifier 66 drops, resetting the flip-flop 64 and closing the shutter 58. In this latter case, the shutter drive mechanism 63 is constructed to open the shutter 58 on receiving one signal from the I output of the flip-flop 64 and to close it on receiving a second signal from the I output of the flip-flop 64.

The block which is designated STEP 3 in FIG. 1 is actually the second most important step of the method and as indicated, it can be exposed for a preset time or in accordance with the level of charge to which the photoconductive surface drops during the exposure. The fixed time step is preferred and is much easier to effect.

Immediately upon completion of the exposing step, toner is applied to the film frame F'. Furthermore, the toner is applied in the presence of a bias field which propels the toner particles toward the film. Not only does this speed up the toning process, it also distributes the toner particles over the charged portions of the frame so as to minimize the edge effect which characterizes images made by the usual xerographic processes.

In accordance with the invention, the commencement of the toning step as indicated by the STEP 4 block in FIG. 1 follows immediately after exposure. Looking at FIGS. 2 and 2*a*, the step begins at the times 0.330 second and 0.230 second respectively. Toning can be initiated in any one of several ways. In the method where the exposure time is fixed, the output signal from the shutter drive mechanism 63 signifying the end of the period is applied on the line 69 to reset the flip-flop 64 and also appears at the input to the variable one-shot multivibrator 76. In the method where the exposure time is controlled by the level to which the charge on the photoconductive layer drops, the reset signal out of the inverter 72 is applied to the variable one-shot multivibrator 76. Any other suitable method can be used, such as for example, mechanically coupling the shutter 58 itself to a mechanism for toning so that when the shutter closes it simultaneously initiates the toning mechanism.

In the apparatus illustrated the variable one-shot multivibrator 76 is chosen to be of a type which has a variable time constant. The output signal of the multivibrator 76 is applied to the solenoid of a normally closed solenoid valve 78 which is connected in a conduit or pipe line between a liquid toner supply 82 and a toner dispenser 84 positioned adjacent the film frame F'. Again it is appreciated that there will of necessity be relative movement between the film F and the toner dispenser 84. Suitable mechanisms for accomplishing this must be provided but are within the skill of the artisan familiar with this field. As soon as the one-shot multivibrator 76 is triggered by the reset signal the valve 78 opens causing the flow of toner. The dispenser has an aperture 84*a* which is dimensioned to be coextensive with the frame F' when the latter is properly positioned. The liquid toner will bathe the entire frame F'.

An electrode 92 extends around the edge of the aperture 84*a*. This electrode 92 is connected by way of the relay switch 94 to one terminal of a voltage source symbolized by a battery 96 whose second terminal is connected to ground. The output signal of the one-shot multivibrator 76 is also applied to the relay coil 94*a* controlling the switch 94 so that when the one-shot 76 is triggered the relay is closed. This applies a strong, positive potential to the electrode 92 which helps to propel toner particles toward the film to obtain more uniform distribution of toner, especially in areas which are heavily charged, as for example because not having been strongly illuminated.

Toner particles will adhere to those portions of the frame F' which were not illuminated during the exposure step and in varying degree to those areas that were illuminated. The amount of toner which adheres is proportional to the charge of the area or increment. If desired, the bias can be varied inversely with the output of the electrometer 34 so that a higher bias voltage is applied when the amount of light and hence the surface charge is lower. Generally, however, a fixed bias of from 50 to 100 volts d.c. is effective to accomplish the even and complete distribution of toner. Toning can also be done by dry toner using the same general method.

In FIGS. 2 and 2*a*, it will be noted that the toning time is different. The charge on the surface of a photoconductor will affect toning. Higher voltages of charge require less toning time. This is an alternate to greater bias. Thus, assuming that the bias is fixed, for the conditions of illumination represented by the graph of FIG. 2*a*, the light is greater but the charge is lower than in FIG. 2. Operating at lower voltage will require somewhat greater toning time, hence the toning time in FIG. 2*a* is shown to be for a period of 0.770 second instead of 0.670 second in FIG. 2 where the charge voltages are much higher than in the illuminating conditions of FIG. 2*a*.

The time constant setting of the variable one-shot multivibrator 76 could easily be controlled by the maximum level of charge measured by the electrometer 34. A line from the electrometer coupled to the one-shot 76 through suitable control circuitry could provide the necessary information. Otherwise manual means could be provided to vary the time constant of the one-shot 76, the operator referring to a suitable meter reading derived from the electrometer 34.

The structure shown in FIG. 1 uses a fixed toning time. The toning operation ceases upon the resetting of the one-shot multivibrator 76, the time interval depending upon the time constant setting. As soon as the one-shot 76 is quiescent, its output voltage drops. This signal or absence of signal disables the valve 78 thus closing the same. The same signal is used to initiate the next step which is shown in FIG. 1 as the block designated STEP 5 "Immediately Remove Excess Toner."

The signal which is produced when the one-shot 76 has completed its cycle is detected by the differentiator 102 and applied as an input or triggering signal to another variable one-shot multivibrator 104. The time constant of this multivibrator is also capable of being manually adjusted to any desired value. The output from the one-shot 104 is connected to the solenoid valve 108 connected in a line between the vacuum pump 110 and a hood 112 which is open to the frame F′. Any method of applying suction to the frame F′ could be operated by the signal from the one-shot 104. This action immediately sucks excess toner away from the illuminated portions of the frame which retain little or no charge and evaporates the toner solvent so that the latent image on the frame is reduced to visible form.

The step which is designated STEP 5 is not essential to the process for all types of systems. Where systems utilize self-evaporating solvent of powder that will not adhere except at charged areas, it is not necessary to provide any complex apparatus or go through any involved steps to eliminate excess toner. The physical nature of the toner itself and/or the conditions under which it is used may obviate the need for active removal. Accordingly, it should be understood that the expression removal of toner includes any such removal whether done deliberately or where conditions cause the elimination of excess toner without anything being done either by the apparatus or the operator.

The last step which is illustrated in FIG. 1 is the block STEP 6 and is designated FUSE TONER. In this step, the closing of the valve 108 after the variable one-shot 104 has completed its cycle is detected by the differentiator 120 resulting in a signal that is applied to a third variable one-shot multivibrator 124. This latter multivibrator produces a signal whose output turns on a heater or heat lamp 126 backed by a reflector 128 concentrating the infra red rays on the film F. The heat fuses the toner permanently to the photoconductive surface of the film F and after the cycle of the one-shot 124 has been completed, as determined by its time setting, the lamp is turned off and the process of recording the image is completed.

In the event that there is no intervening step line STEP 5, the output from the variable one-shot 104 may be connected directly to the lamp 126 without the intervening elements 120 and 124. If the removal of excess toner automatically requires a small increment of time after the application of toner, the variable one-shot signal from 104 can be delayed by any suitable electronic delay means.

The process of the invention also contemplates that there may be a transfer step between STEPS 5 and 6. Thus, if the film F is to be used to transfer images to a paper or other acceptor member such transfer will be effected immediately after toning. This is indicated by the broken line channel extending from the block STEP 5 to the block STEP 5A, this latter being designated "Transfer." Transfer may be effected by mechanical pressure or corona transfer means. Thereafter, the broken line indicating the process step sequence extends to the block STEP 6. Fusing is accomplished on the toner transferred to the acceptor member.

Obviously the apparatus of the invention will take a variety of forms including simple structures designed to be used photographically and operated to a great extent manually, but embodying the invention.

The electrophotographic film can be processed in accordance with the foregoing technique either on a straight-line basis with the several stations depicted in FIG. 1 being located along a line perpendicular to the path of film travel. As a film frame incrementally moves into position, the successive stations can be advanced sequentially past that frame.

Figure 3:
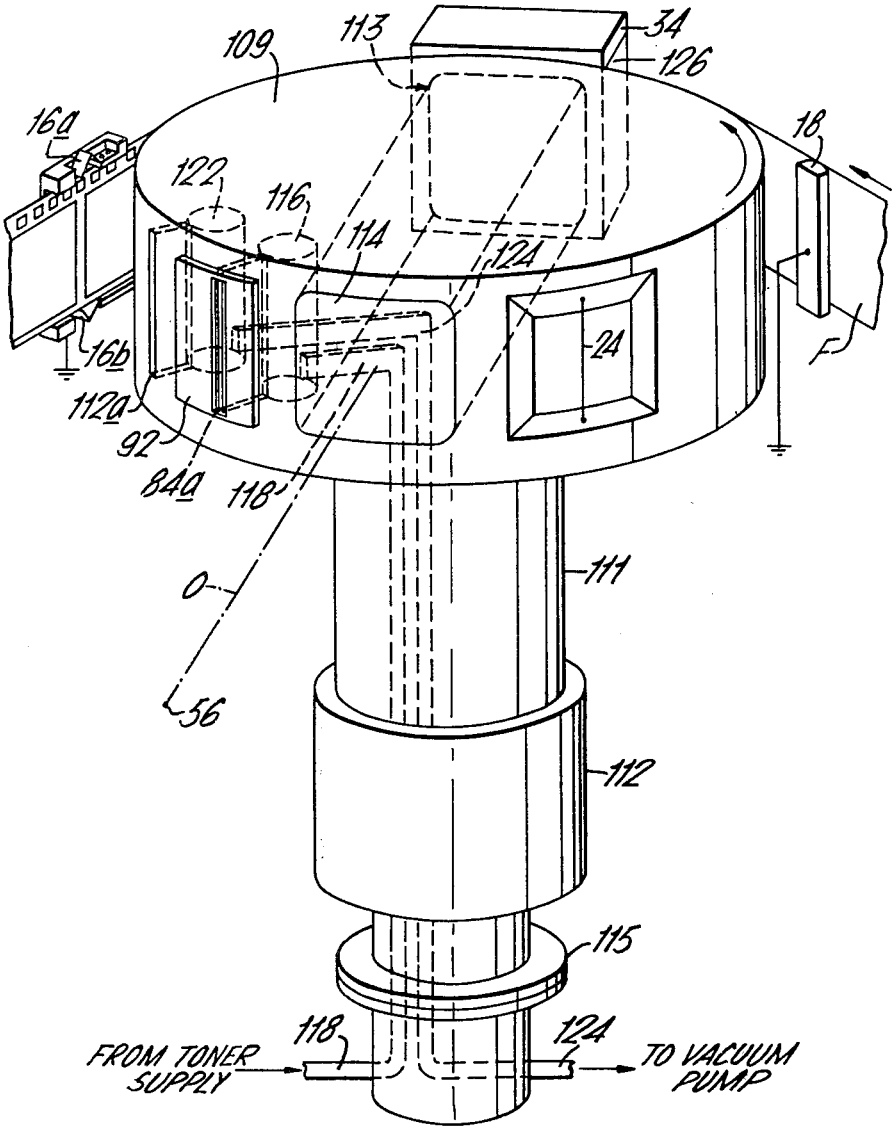
FIG. 3 is a diagrammatic view of another embodiment of the invention.

FIG. 3 shows an embodiment of the present system wherein most of the processing components depicted in FIG. 1 are mounted on the periphery of a cylindrical rotary drum 110. The drum is mounted on a hollow shaft 111 driven by a servomotor 112. The film F is trained around the periphery of drum 110 and is moved from right to left frame-by-frame through a ready station shown generally at 113. The components of the FIG. 3 apparatus which are similar to those depicted in FIG. 1 bear similar identifying numerals.

On the way to station 113, each frame passes the discharge head 18 which removes any residual charge on the film. As understood, this head may not be needed. Also, it could comprise a brilliant light that discharges the film. After the frame reaches station 113, the head is rotated one revolution counterclockwise to advance the various processing components past the film frame. First the corona wire 24 is swept past the film to charge the frame, the charge being monitored by electrometer 34 as described above. Next the frame is exposed. In this case, the shutter 58 of FIG. 1 is replaced by a tunnel 114 extending diametrically through drum 110. When the drum is positioned as shown in FIG. 3, the tunnel 114 is aligned parallel to the optical axis O of a projector 56 which is illuminating the frame. In this case, the projector has a curved field lens to compensate for the curvature of the image plane containing the film frame.

In the FIG. 3 system, the duration of the exposure is dependent upon the angular velocity of drum 110. This can either be constant for the preferred method or may be controlled by controlling speed of servomotor 112 using the same inputs that controlled shutter 58 of FIG. 1 as the mouth of the tunnel sweeps by the frame.

Next, toner is applied to the film frame when an aperture 84*a* moves past the frame. Manifold 116 inside drum 110 communicates with the aperture 84*a* and toner is supplied to this manifold by way of a pipe 118 which extends down through shaft 111 and communicates via a rotary coupling 115 with a toner supply. Also, an electrode 92 is positioned around slit 84*a* to propel the toner particles toward the film as described above.

Immediately following the toning step, excess toner may be removed from the film when the aperture 112*a* rotates past the frame at station 113. The aperture 112*a* communicates with a manifold 122 inside drum 110 which is connected by a suitable pipe 124 via coupling 115 to a vacuum pump.

The advance of aperture 112*a* past the film marks one complete revolution of drum 110. A heater in the form of an infrared lamp 126 positioned directly behind the film frame at station 113 is then energized as described above to fuse the toner remaining on the film frame, thereby completing the processing operation. Following this, the film F is moved so that the next frame is brought into station 113 for processing.

Actually, the durations of the charging, exposing and toning steps can all be controlled by varying the speed of drum 110 over its cycle.

Figure 4:
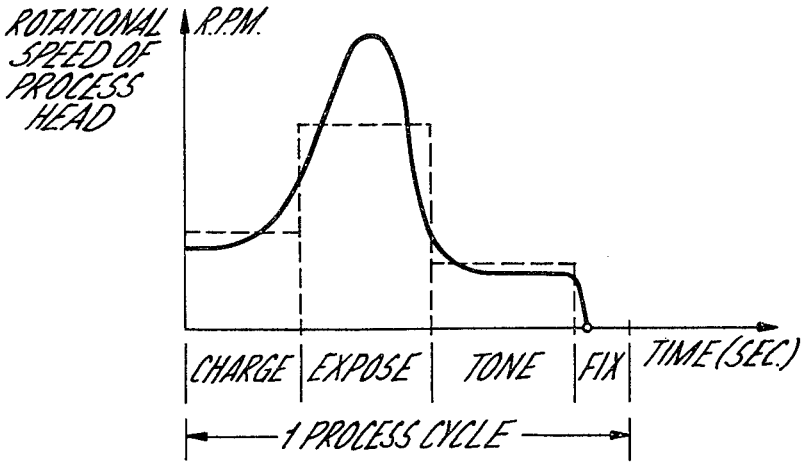
FIG. 4 is a graph illustrating the operation of the system of FIG. 3.

FIG. 4 is a graph which indicates how the angular velocity of the drum 110 can be varied during different portions of each operating cycle to vary the time when each processing station is operative on the film frame. The control signals required to do this are developed in much the same way as described above in connection with the processing steps and apparatus described in connection with FIG. 1.

In a somewhat similar approach, the various processing components can be distributed around the periphery of a rotary disk. The film to be processed is advanced past the disk near its periphery and the disk is rotated to bring the various stations into position opposite the ready frame. The operation of that system would be more or less like that of the apparatus shown in FIG. 3.

It may hardly seem necessary in view of the above to point out that considerable variation may be made in the apparatus and the method of the invention without departing from the spirit or scope of the invention as defined in the appended claims. For example, in choosing the surface potential which is represented by a condition of charge of the photoconductive coating 12 the most logical method of doing so is to measure the surface directly by a suitable voltmeter, referred to hereinabove as an electrometer. This would normally take into account any variations which could result from differences in the conditions that exist in the surrounding vicinity that might change the response of the surface to a given corona voltage. In other words, irrespective of the corona voltage which might be higher or lower depending upon humidity, variations in the aging of components and the like, a reading of potential at the surface would be absolute. A simplified device which would not operate as well could have a control of corona voltage related to the response of the light meter in an effort to produce a more economical device. Since this is in effect control of the surface charge, the invention includes this expedient and reference to measurement or control of the potential of the surface charge of the coating should be taken as encompassing control by adjusting the corona voltage.

In other simplified apparatus, it is not impractical to have a manual control which sets constants of the power supply for the corona voltage over a dial calibrated in readings of the light meter. The operator then reads the light meter, sets the value of the reading on the dial and thereafter initiates the operation of the power supply circuit knowing that the corona voltage will quickly rise to a certain value which he has adjusted for. Another and more sophisticated arrangement which is nevertheless not fully automatic would have a circuit whose corona power supply is energized by a control that responds to surface potential of the coating. The control includes a manual adjustment that moves over a dial calibrated in light values but represents surface potential. The corona power supply would be energized manually by the operator and rise in voltage until the signals provided by the manual adjustment device and the surface charge are equal (or have a certain relationship). At that point the charging is stopped.

In still another arrangement alternate to adjusting the surface potential to which the film frame F′ is charged, it is feasible to construct apparatus in which the charging level is fixed for all conditions, but means are provided to vary the amount of light projected onto the frame. This latter is done by adjusting an iris in the projector 56 and/or varying the speed of the shutter 58. A comparison is readily made by the photocell 32 and the voltage measuring device 34 which measures the surface potential of an increment of the frame F′ in darkness, and the resulting information used, manually for automatically to effect the light adjustment. The comparison values will previously have been determined and been built into the apparatus, using means differing in only minor respects to those previously described hereinabove.

In all of these cases and as well in the specific structures illustrated and described in detail, there is in effect a measurement of the amount of light and a measurement of the potential of the surface charge, whether directly or indirectly. Furthermore, even though there may be preset conditions which are manually produced by adjustment of dials or controls it is within the ambit of this invention to consider that such measurements are being made continuously even where preset at some value which is reached after a period of time. These meanings are to be taken by definition.

What it is desired to secure by Letters Patent of the United States is:

1. Apparatus for recording images of a projected scene or the like on a photoconductive coating of an electrophotographic member which comprises:

A. means for projecting the image onto the member and including controllable light passing means to enable timed exposure of the said coating, B. means for charging the coating in darkness at a rapid rate, C. control means for operating the light passing means to expose the photoconductive coating to the projected image, D. means for applying toner to the coating to render a latent charge image visible, E. means for timing variably the periods of charging, exposure and toning, including means coupled thereto for detecting the completion of each of said periods, F. first and second signal producing means connected with said timing means to produce a first signal when the charging period is completed and a second signal when the exposure period is completed, G. the signal producing means being coupled to the charging means, control means and toner applying means and the latter three means being responsive to said signals such that the three means are set into operation sequentially, the completion of the charging period starting the exposure period and the completion of the exposure period starting the toning period.

2. Apparatus as claimed in claim 1 in which there are toner fusing means and said timing means include means for timing the period of fusing, there being third signal producing means to produce a third signal when the toning time is completed, the toner fusing means being responsive to said third signal to be set into operation upon completion of the toning period.

3. Apparatus as claimed in claim 1 in which the toner applying means include an electrical bias circuit for propelling toner to the coating to achieve even distribution thereof on said coating.

4. Apparatus for recording images of a projected scene or the like comprising an electrophotographic member having a photoconductive coating, means for projecting the image onto the member and including controllable light passing means to enable timed exposure of said coating, means for charging the coating in darkness at a rapid rate, control means for operating the light passing means to expose the photoconductive coating to the projected image, means for applying toner to the coating to render a latent charge image visible, means for timing the period of charging, exposure and toning, first and second signal producing means connected with said timing means to produce a first signal when the charging period is completed and a second signal when the exposure period is completed, the signal producing means being coupled to the charging means, control means and toner applying means and the latter three means being responsive to said signals such that the three means are set into operation sequentially, the completion of the charging period starting the exposure period and the completion of the exposure period starting the toning period, and said member comprising a belt like strip of individual frames adapted to be moved relative to said charging, light passing and toner applying means, said latter three means being disposed at stations along the path of movement of said strip and said timing means being connected with means for moving said strip relative to said stations.

5. Apparatus as claimed in claim 4 which includes a rotary support member, said stations being distributed around the peripheral portions of said rotary support member and further including means for rotating the support member so as to move the stations successively past the electrophotographic member.

6. Apparatus as claimed in claim 5 in which the projecting means are situated on the opposite side of said rotary support member from said electrophotographic member and arranged to project an image toward said electrophotographic member and a window in said rotary support member is aligned with said projecting means and electrophotographic member during a small segment of each revolution of said rotary member.

7. Apparatus as claimed in claim 4 in which there are toner fusing means and said timing means include means for timing the period of fusing, there being third signal producing means to produce a third signal when the toning time is completed, the toner fusing means being responsive to said third signal to be set into operation upon completion of the toning period.

8. Apparatus as claimed in claim 4 in which the toner applying means include an electrical bias circuit for propelling toner to the coating to achieve even distribution thereof on said coating.

* * * * *